US012078431B2

(12) United States Patent
Joardar et al.

(10) Patent No.: US 12,078,431 B2
(45) Date of Patent: Sep. 3, 2024

(54) MICROCHANNEL HEAT EXCHANGER FOR A FURNACE

(71) Applicant: Carrier Corporation, Palm Beach Gardens, FL (US)

(72) Inventors: Arindom Joardar, Jamesville, NY (US); Kevin Mercer, Danville, IN (US); Robert A. Leffler, Boston, MA (US); Tobias H. Sienel, Baldwinsville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/508,566

(22) Filed: Oct. 22, 2021

(65) Prior Publication Data

US 2022/0128320 A1 Apr. 28, 2022

Related U.S. Application Data

(60) Provisional application No. 63/104,844, filed on Oct. 23, 2020.

(51) Int. Cl.

| | |
|---|---|
| ***F28F 1/12*** | (2006.01) |
| ***F28F 1/22*** | (2006.01) |
| *F28D 1/047* | (2006.01) |

(52) U.S. Cl.

CPC ..... *F28F 1/128* (2013.01); *F28F 1/22* (2013.01); *F28D 1/0476* (2013.01); *F28F 2215/08* (2013.01); *F28F 2275/04* (2013.01)

(58) Field of Classification Search

CPC . F28D 1/0476; F28F 1/128; F28F 1/22; F28F 2215/04; F28F 2215/08; F28F 2275/04

See application file for complete search history.

(56) References Cited

U.S. PATENT DOCUMENTS 4,756,362 A * 7/1988 Kudoh ..... F28F 1/128 165/151
5,329,988 A * 7/1994 Juger ..... F28F 1/128 165/152

(Continued)

FOREIGN PATENT DOCUMENTS

CN 101614501 A 12/2009
CN 101995172 B 3/2011

(Continued)

OTHER PUBLICATIONS

Erbay et al.; "Comprehensive Study of Heat Exchangers with Louvered Fins"; Intech; Chapter 4; pp. 61-92.

(Continued)

*Primary Examiner* — Eric S Ruppert
*Assistant Examiner* — Hans R Weiland
(74) *Attorney, Agent, or Firm* — CANTOR COLBURN LLP

(57) ABSTRACT

A microchannel heat exchanger having: fin segments defined between lower and upper fin tips; at each fin tip, the fin segments have inner and outer facing surfaces; each fin segment having louvers having: an upper transition region at an upper louver end, adjacent an upper fin tip; a lower transition region at a lower louver end, adjacent a lower fin tip; and a straight region extending therebetween, wherein: the transition regions along the inner facing surface at each fin tip have a first transition surface having a first transition length, disposed at a first transition angle; the transition regions along the outer facing surface at each fin tip have a second transition surface having a second transition length, disposed at a second transition angle; wherein: the first transition length is longer than the second transition length; and/or the first transition angle is smaller than the second transition angle.

19 Claims, 7 Drawing Sheets

(56) References Cited

U.S. PATENT DOCUMENTS

| | | | | |
|---|---|---|---|---|
| 5,669,438 | A * | 9/1997 | Beales | F28F 1/128 165/152 |
| 5,787,972 | A * | 8/1998 | Beamer | F28F 1/128 165/152 |
| 6,253,840 | B1 | 7/2001 | Kuroyanagi | |
| 6,907,919 | B2 | 6/2005 | Zhang | |
| 6,988,538 | B2 | 1/2006 | Merkys et al. | |
| 7,921,904 | B2 | 4/2011 | Matter et al. | |
| 8,333,088 | B2 | 12/2012 | Taras et al. | |
| 8,408,283 | B2 | 4/2013 | Kolb | |
| 8,439,104 | B2 | 5/2013 | De La Cruz et al. | |
| 9,115,939 | B2 | 8/2015 | Huazhao et al. | |
| 9,574,827 | B2 | 2/2017 | Troutman | |
| 9,752,833 | B2 | 9/2017 | Gao et al. | |
| 9,803,935 | B2 | 10/2017 | Kamada et al. | |
| 9,863,714 | B2 | 1/2018 | Seo et al. | |
| 10,168,083 | B2 | 1/2019 | Wang et al. | |
| 10,415,887 | B2 | 9/2019 | Liu et al. | |
| 10,422,588 | B2 | 9/2019 | Smith et al. | |
| 10,619,932 | B2 | 4/2020 | Adomat | |
| 2004/0251004 | A1* | 12/2004 | Stoynoff, Jr. | F28F 1/128 165/152 |
| 2007/0012430 | A1* | 1/2007 | Duke | F28F 1/128 165/109.1 |
| 2009/0173478 | A1* | 7/2009 | Beamer | F28F 1/128 165/151 |
| 2010/0071868 | A1 | 3/2010 | Reifel et al. | |
| 2010/0258286 | A1* | 10/2010 | Yuan | F28F 1/126 165/173 |
| 2011/0036550 | A1* | 2/2011 | Jiang | F28F 1/128 165/173 |
| 2011/0048688 | A1* | 3/2011 | Leitch | F28F 1/128 165/173 |
| 2012/0227945 | A1 | 9/2012 | Taras et al. | |
| 2013/0153174 | A1 | 6/2013 | Taras et al. | |
| 2013/0299142 | A1* | 11/2013 | Yoshioka | F28F 17/005 165/151 |
| 2015/0000880 | A1* | 1/2015 | Gosh | F28F 1/128 165/151 |
| 2016/0025424 | A1* | 1/2016 | Mabuchi | F28F 1/128 165/151 |
| 2017/0356697 | A1* | 12/2017 | Viehrig | F28F 1/128 |
| 2018/0231319 | A1 | 8/2018 | Lee et al. | |
| 2019/0195572 | A1* | 6/2019 | Jo | F28F 1/126 |
| 2019/0249925 | A1 | 8/2019 | Morley et al. | |
| 2019/0285361 | A1* | 9/2019 | Magnier | F28F 1/128 |
| 2019/0368831 | A1* | 12/2019 | Xu | F28F 1/128 |
| 2020/0096264 | A1* | 3/2020 | Morimoto | F28F 1/128 |
| 2020/0103148 | A1 | 4/2020 | Matsumoto et al. | |

FOREIGN PATENT DOCUMENTS

| | | | |
|---|---|---|---|
| CN | 201844617 | U | 5/2011 |
| CN | 201876180 | U | 6/2011 |
| CN | 101694360 | B | 3/2012 |
| CN | 202188697 | U | 4/2012 |
| CN | 202255020 | U | 5/2012 |
| CN | 101865625 | B | 9/2012 |
| CN | 102878851 | A | 1/2013 |
| CN | 202747691 | U | 2/2013 |
| CN | 102252556 | B | 4/2013 |
| CN | 103307924 | A | 9/2013 |
| CN | 102767982 | B | 8/2014 |
| CN | 104807360 | A | 7/2015 |
| CN | 105135753 | A | 12/2015 |
| CN | 205027190 | U | 2/2016 |
| CN | 205536685 | U | 8/2016 |
| CN | 206037490 | U | 3/2017 |
| CN | 206160791 | U | 5/2017 |
| CN | 109945552 | A | 6/2019 |
| CN | 110094901 | A | 8/2019 |
| EP | 0962736 | A2 | 12/1999 |
| EP | 2236972 | A2 | 10/2010 |
| EP | 2769162 | A1 | 4/2013 |
| EP | 3491323 | A1 | 2/2018 |
| EP | 2962055 | B1 | 5/2018 |
| EP | 2908082 | B1 | 3/2019 |
| EP | 2369285 | B1 | 8/2020 |
| WO | 2005075917 | A1 | 8/2005 |
| WO | 2014029216 | A1 | 2/2014 |
| WO | 19177430 | A1 | 9/2019 |

OTHER PUBLICATIONS

Hrnjak et al.; "Effect of Louver Angle on Performance of Heat Exchanger with Serpentine Fins and Flat Tubes in Periodic Frosting"; International Refrigeration and Air Conditioning Conference; Jul. 16-19, 2012; 16 Pages.

Jang et al.; "Optimum Louver Angle Design for a Louvered Fin Heat Exchanger"; International Journal of the Physical Sciences; vol. 6, No. 28; Nov. 9, 2011; pp. 6422-6438.

* cited by examiner

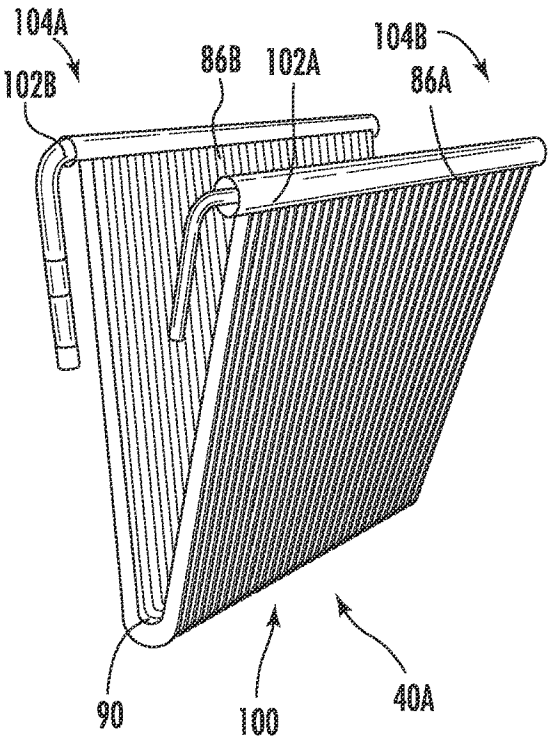
FIG. 4
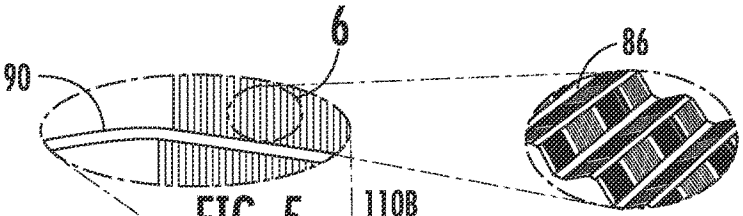
FIG. 6
FIG. 5
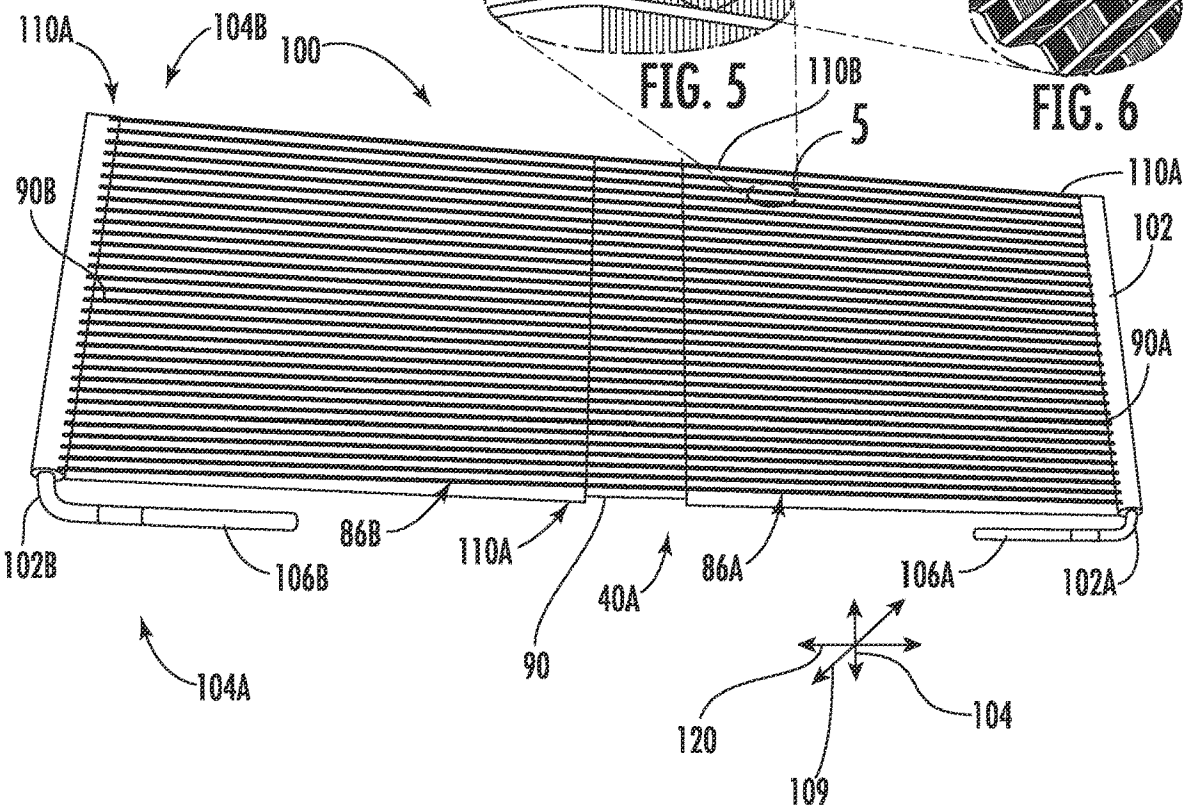
FIG. 3

MICROCHANNEL HEAT EXCHANGER FOR A FURNACE

CROSS-REFERENCE TO RELATED APPLICATIONS

This application claims the benefit of U.S. Provisional Patent Application No. 63/104,844 filed Oct. 23, 2020, the disclosure of which is incorporated herein by reference in its entirety.

BACKGROUND

Exemplary embodiments pertain to heat exchangers and more specifically to high performance louvered fin microchannel heat exchangers performing cooling and dehumidification such as for a furnace-coil evaporator.

An air-cooled fin-type heat exchanger is very well known. Heat exchangers are used for changing the temperature of various working fluids, such as air conditioning refrigerant, an engine coolant, an engine lubricating oil and an automatic transmission fluid, for example. The heat exchanger typically includes a plurality of spaced apart fluid conduits or tubes connected between an inlet tank and an outlet tank, and a plurality of heat exchanging fins disposed between adjacent conduits. Air is directed across the fins of the heat exchanger by a cooling fan or air mover in general. As the air flows across the fins, heat in a fluid flowing through the tubes is conducted through the walls of the tubes, into the fins, and transferred into the air. In the case of comfort cooling applications, humid and warm air moves through the fin-tube matrix resulting in moisture removal as condensate and rejection of the heat into the refrigerant flowing in the tubes.

One of the primary goals in heat exchanger design is to achieve the highest possible thermal efficiency. Thermal efficiency is measured by dividing the amount of heat that is transferred by the heat exchanger under a given set of conditions (amount of airflow, temperature difference between the air and fluid, and the like) by the theoretical maximum possible heat transfer under those conditions. Thus, an increase in the air-side heat transfer coefficient results in increased thermal capacity and hence higher thermal efficiency. For heat exchangers operating as evaporators, reduction in retained condensate and lower water film thickness on fin surfaces also reduces thermal resistance and increases rate of heat transfer.

In the case of the louvered serpentine fins in microchannel heat exchangers, the air-side thermal performance and condensate drainage is intimately dependent on the fin design at large and the louver geometry. Over the decades, the louvered-fin design has undergone many slight modifications to optimize the existing parameters that describe the fin. Louver width has varied, louver angle has varied, bend radii have improved, louver patterns have been experimented with, and fin materials have become more versatile and thinner. But through all the experimentation and slight improvements, the design of the louver transition zone itself has remained relatively untouched due to its complexity. It is the louver transition that determines the extent to which the louver length can be achieved. The larger the louver length greater the air-side heat transfer coefficient and thermal capacity. At the same time, an optimized louver transition helps reduce air-side pressure drop and lowers the risk of condensate blow-off. The fin-tip bend radii also present a challenge for maximizing the louver length. Conventional semi-circular profiles with generous radii conflict with efforts to increase louver length. Prior art flat-top fin designs tend to alleviate the bend radii limitations, but present significant manufacturing challenges and poor braze quality which have prevented them from wide adoption by the industry. Newer approaches are needed to circumvent these technical difficulties.

In furnace-coil evaporators, it may be desirable to replace tube-and-fin coils with microchannel heat exchangers to provide enhanced performance and cost benefits. The configuration of the microchannel heat exchangers should be optimized however to maximize the performance and costs benefits.

BRIEF DESCRIPTION

A microchannel heat exchanger including: a plurality of fin segments, each respectively defined between a pair of lower and upper fin tips, and wherein at each fin tip, the fin segments include inner facing surfaces and outer facing surfaces; each fin segment including louvers, each louver including an upper transition region at an upper louver end adjacent an upper fin tip, a lower transition region at a lower louver end adjacent a lower fin tip, and a straight region extending between the upper transition region and the lower transition region, wherein: the transition regions along the inner facing surface at each fin tip include a first transition surface including a first transition length, disposed at a first transition angle to the fin segment; the transition regions along the outer facing surface at each fin tip include a second transition surface including a second transition length, disposed at a second transition angle to the fin segment; and one or more of: the first transition length is longer than the second transition length; and the first transition angle is smaller than the second transition angle.

In addition to one or more features of the microchannel heat exchanger, or as an alternate, the microchannel heat exchanger further includes at least one tube brazed along at least one of: the lower fin tips or the upper fin tips.

In addition to one or more features of the microchannel heat exchanger, or as an alternate, the microchannel heat exchanger further includes a fluid header and a gas header fluidly connected to the tube at opposing longitudinal ends of the tube.

In addition to one or more features of the microchannel heat exchanger, or as an alternate, the fin segments, between the upper and lower fin tips, are configured at an acute angle.

In addition to one or more features of the microchannel heat exchanger, or as an alternate, each fin tip includes a rounded profile.

Further disclosed is another microchannel heat exchanger including: a plurality of fin segments, each respectively defined between a pair of lower and upper fin tips, and wherein at each fin tip, the fin segments include inner facing surfaces and outer facing surfaces; each fin segment including louvers, each louver including an upper transition region at an upper louver end adjacent an upper fin tip, a lower transition region at a lower louver end adjacent a lower fin tip, and a straight region extending between the upper transition region and the lower transition region; wherein, at each of the fin tips: one of the fin segments is longer than another one of the fin segments, and the respective fin tip includes a straight profile extending between the pair of the fin segments, thereby forming a trapezoidal fin profile.

In addition to one or more features of the another microchannel heat exchanger, or as an alternate, the fin segments each include louvers formed thereon, wherein louvers formed on longer ones of the fin segments are longer than louvers formed on shorter ones of the fin segments.

In addition to one or more features of the another microchannel heat exchanger, or as an alternate, the another microchannel heat exchanger further includes at least one tube brazed along at least one of: the lower fin tips or the upper fin tips.

In addition to one or more features of the another microchannel heat exchanger, or as an alternate, the another microchannel heat exchanger further includes a fluid header and a gas header fluidly connected to the tube at opposing longitudinal ends of the tube.

In addition to one or more features of the another microchannel heat exchanger, or as an alternate, the fin segments are parallel to each other.

Disclosed is a further microchannel heat exchanger including: a plurality of fin segments, each respectively defined between a pair of lower and upper fin tips, and wherein at each fin tip, the fin segments include inner facing surfaces and outer facing surfaces; each fin segment including louvers, each louver including an upper transition region at an upper louver end adjacent an upper fin tip, a lower transition region at a lower louver end adjacent a lower fin tip, and a straight region extending between the upper transition region and the lower transition region, wherein: for each fin segment, the louvers include an inner louver bank disposed between the fin inner end and a fin bisecting axis, and an outer louver bank disposed between the fin outer end and the fin bisecting axis; and the upper and lower louver ends of the inner louver bank define an inner-side louver angle by that is acute relative to the longitudinal direction, such that each louver slot forms an air scoop, and wherein the outer louver bank mirrors the inner louver bank about the fin bisecting axis.

In addition to one or more features of the further microchannel heat exchanger, or as an alternate, the further microchannel heat exchanger includes at least one tube brazed along at least one of: the lower fin tips or the upper fin tips.

In addition to one or more features of the further microchannel heat exchanger, or as an alternate, the further microchannel heat exchanger includes a fluid header and a gas header fluidly connected to the tube at opposing longitudinal ends of the tube.

In addition to one or more features of the further microchannel heat exchanger, or as an alternate, the inner and outer louver banks have a same span along the depth direction and are spaced apart from each other by a louver gap.

In addition to one or more features of the further microchannel heat exchanger, or as an alternate, the further microchannel heat exchanger includes one or more of: a ratio of louver width to louver length of between 0.06 to 0.32; the ratio of louver width to louver length of between 0.10 to 0.18; a ratio of louver length to fin height of between 0.85 and 0.95; the ratio of louver length to fin height of between 0.88 and 0.92; a ratio of fin height to fin thickness of between 40 and 200; the ratio of fin height to fin thickness of between 88 and 102; a ratio of louver transition length to fin thickness of between 1 and 10; the ratio of louver transition length to fin thickness of between 3 and 5; a louver transition angle of between 15 degrees and 50 degrees; a ratio of louver width and fin thickness is between 5 and 35; the ratio of louver width and fin thickness is between 10 and 15; a ratio of fin tip radius to fin pitch of between 0.068 to 0.42; and the ratio of fin tip radius to fin pitch of between 0.2 to 0.25.

Further disclosed is an alternate microchannel heat exchanger including: a plurality of fin segments, each respectively defined between a pair of lower and upper fin tips, and wherein at each fin tip, the fin segments include inner facing surfaces and outer facing surfaces; each fin segment including louvers, each louver including an upper transition region at an upper louver end adjacent an upper fin tip, a lower transition region at a lower louver end adjacent a lower fin tip, and a straight region extending between the upper transition region and the lower transition region, wherein at least one tube is connected along at least one of the lower fin tips or the upper fin tips, the tube extending from an upstream tube end to a downstream tube end; wherein the tube is internally segmented by webs to form ports, wherein the ports at opposing ends define end ports and the ports therebetween define internal ports, wherein the internal ports define include a rectangular cross section.

In addition to one or more features of the alternate microchannel heat exchanger, or as an option thereto, the tube is brazed to the fin tips.

In addition to one or more features of the alternate microchannel heat exchanger, or as an option thereto, the alternate microchannel heat exchanger includes a fluid header and a gas header fluidly connected to the tube at opposing longitudinal ends of the tube.

In addition to one or more features of the alternate microchannel heat exchanger, or as an option thereto, the end ports include semi-rounded profiles.

In addition to one or more features of the alternate microchannel heat exchanger, or as an option thereto, the alternate microchannel heat exchanger includes one or more of: a port height of between 0.2 mm and 1.2 mm; the port height of between 0.6 mm and 0.8 mm; a port width of between 0.2 mm and 2 mm; the port width of between 0.5 mm and 0.7 mm; an end port width of between 0.2 mm and 2 mm; the end port width of between 0.2 mm and 0.6 mm; a port corner radius of between 0.1 mm and 0.3 mm; a ratio of nose thickness to web thickness of between 0.5 and 5; the ratio of nose thickness to web thickness of between 1.5 and 2.5; a ratio of total web thickness to tube width of between 0.20 and 0.40; the ratio of total web thickness to tube width of between 0.28 and 0.32; a ratio of tube wall thickness to tube height of between 0.16 and 0.40; and the ratio of tube wall thickness to tube height of between 0.21 and 0.25.

Additional one or more microchannel heat exchangers combining aspects of one or more of the microchannel heat exchangers identified herein are within the scope of the disclosure.

BRIEF DESCRIPTION OF THE DRAWINGS

The following descriptions should not be considered limiting in any way. With reference to the accompanying drawings, like elements are numbered alike:

FIG. 3 shows an exemplary microchannel heat exchanger prior to being formed into an A-frame configuration for use in the exemplary HVAC system of FIG. 1, in accordance with one aspect of the disclosure;

FIG. 4 shows the exemplary microchannel heat exchanger of FIG. 3 formed into an A-frame configuration for use in the exemplary HVAC system of FIG. 1, in accordance with one aspect of the disclosure;

FIG. 5 shows a section of the exemplary microchannel heat exchanger of FIG. 4, in accordance with one aspect of the disclosure;

FIG. 6 shows an exemplary fin in the section of FIG. 5 of the exemplary microchannel heat exchanger of FIG. 5, in accordance with one aspect of the disclosure;

DETAILED DESCRIPTION OF THE DISCLOSED EMBODIMENTS

Figures 1, 2:
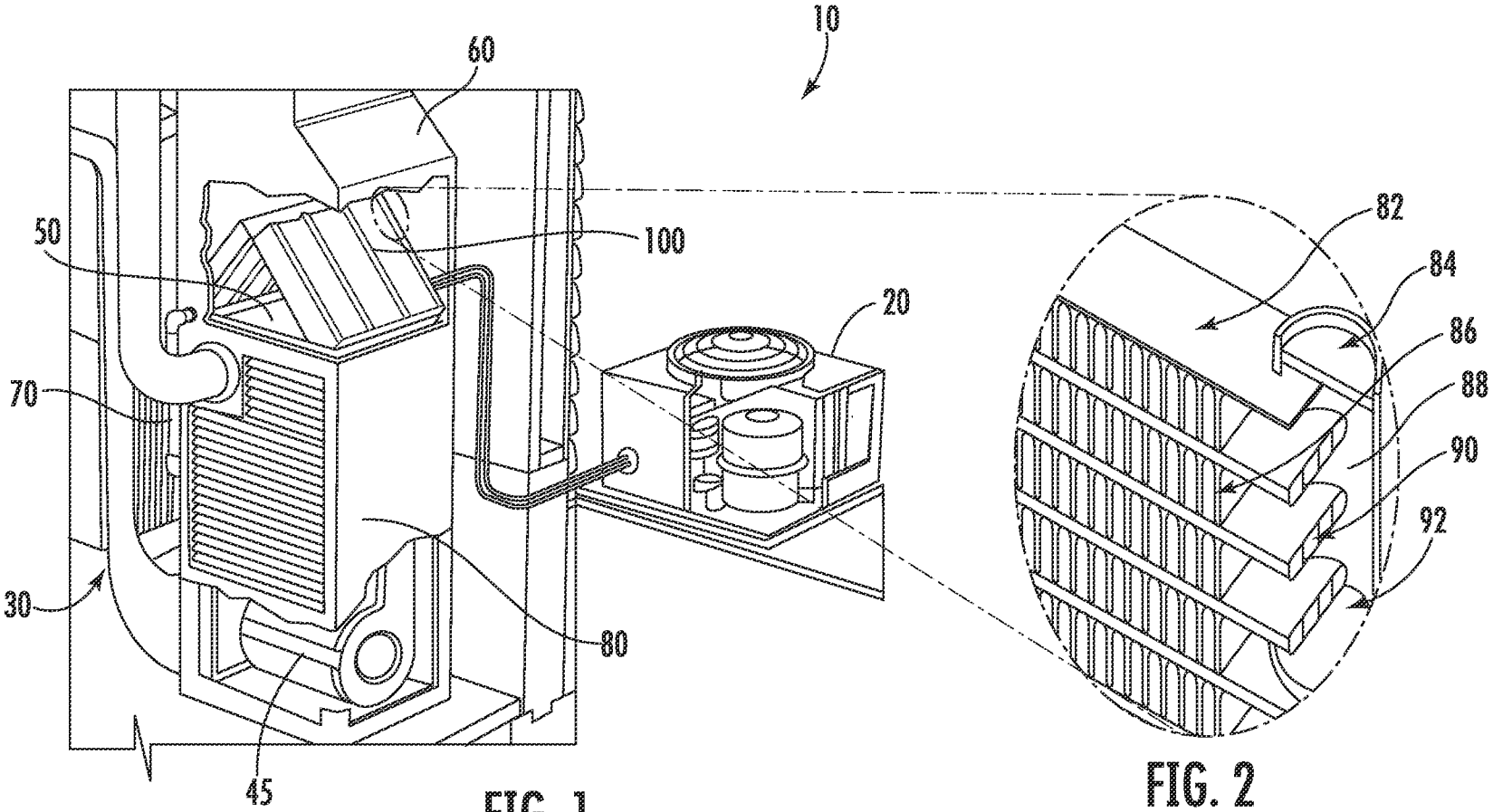
FIG. 1 is a schematic illustration of an exemplary HVAC system, in accordance with one aspect of the disclosure.
FIG. 2 shows a closeup of a portion of an exemplary microchannel heat exchanger that may be utilized in the exemplary HVAC system of FIG. 1, in accordance with one aspect of the disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates an exemplary heating, ventilation and air conditioning (HVAC) system 10. The HVAC system 10 shown includes an outdoor unit 20 and an indoor unit 30. The indoor unit 30, which may also be referred to as an air handler, may include a heat exchanger coil 100 (e.g., which may be referred to as a coil or as a heat exchanger), a blower 45, a plenum 60 and evaporator drain lines 70. The coil 100 may be a microchannel heat exchanger (e.g., installed in an A-frame configuration). The coil 100 may be disposed over a drain pan 50, which may also be referred to as a condensate receptor. The indoor unit 30 also includes a housing 80. As illustrated in FIG. 2, the coil 100 may include typical features including a side plate 82, an end cap 84, a fin 86, a header 88, a microchannel tube (tube) 90 and an air baffle 92.

Turning to FIGS. 3-6, additional features are shown of the microchannel heat exchanger 100 of the indoor unit 40. FIG. 3 shows the microchannel heat exchanger 100 prior to being formed into an A-frame shape, and FIG. 4 shows the microchannel heat exchanger 100 after being formed, e.g., bent around a bend section 40*a*, into an A-frame shape. As shown, the microchannel heat exchanger 100 may include headers 102, such as a fluid header 102A, or upstream header. The microchannel heat exchanger 100 also may include a gas header 102B, or downstream header. The upstream and downstream headers 102A, 102B may be viewed as header tubes extending in a axial direction 104 to define a first axial end 104A and a second axial end 104B. The headers 102 may have respective ports 106A, 106B and the first axial end 104A.

The tubes, referred to generally as 90, may extend between the upstream and downstream headers 102A, 102B and may be spaced apart from each other in the axial direction 104. A width of the tubes 90 defines a flow depth direction 109 aligned with the airflow direction.

The microchannel heat exchanger 100 includes fins, referred to generally as 86. The fins 86 may be brazed to the tubes 90. As shown, the fins 86 may define a periodic waveform. The fins 86 may be upstream fins 86A that extend between the upstream header 102A and the bend section 40A. The fins 86 may be downstream fins 86B that extend between the downstream header 102B and the bend section 40A. The upstream and downstream fins 86A, 86B may be spaced apart from each other in the longitudinal direction 120 parallel to tube axis and aligned with refrigerant flow direction. Each fin 86 may have an upstream fin end 110*a* and a downstream fin end 110*b* spaced apart in a longitudinal direction 120.

Figure 7:
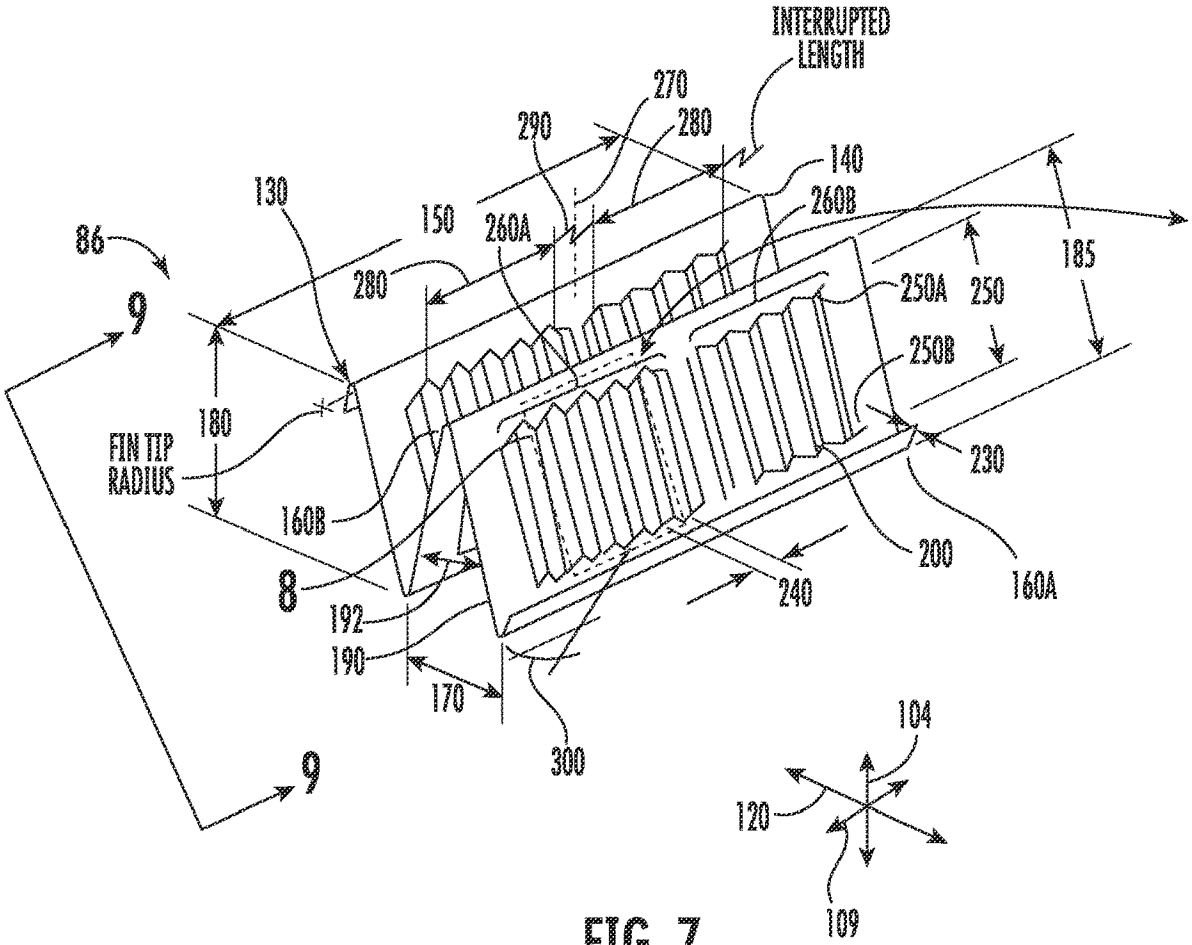
FIG. 7 shows additional details of the exemplary fin of FIG. 6, in accordance with one aspect of the disclosure.

Turning to FIG. 7, each fin 86 may be viewed to include a fin inner end 130, and a fin outer end 140 spaced apart from each other along the depth direction 109 by a fin length 150.

Fin apex tips, or fin tips, referred to generally as 160, which may include lower fin tips generally referred to as 160A, may be spaced apart from each other in a longitudinal direction 120 by a fin pitch 170. Upper fin tips, generally referred to as 160B may also be spaced apart from each other in the longitudinal direction 120 by the fin pitch 170. The lower and upper fin tips 160A, 160B may be spaced apart from each other along the axial direction 104 by a tube pitch 180 corresponding to a shortest distance between two adjacent tubes. A length of the fin 86 between the lower and upper fin tips 160A, 160B, which is at an acute angle to the axial direction 104, defines the fin height 185. As can be appreciated, for a fin 86 having a triangular wave form (shown in FIGS. 7 and 9) the fin height 185 is greater than the tube pitch 180. In one embodiment, the lower and upper fin tips 160A, 160B are rounded, e.g., with a semi-circular in cross section.

Figure 8:
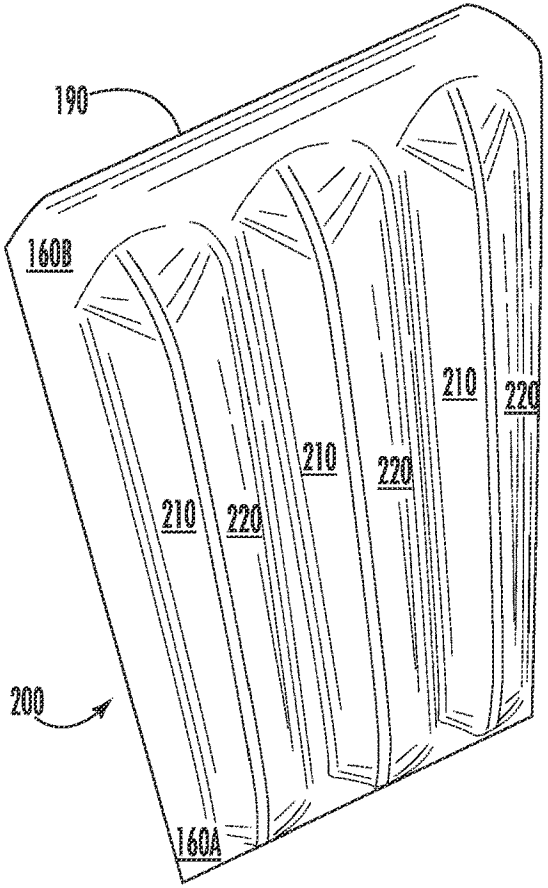
FIG. 8 shows a section of the exemplary fin of FIG. 7, in accordance with one aspect of the disclosure.
Figure 9:
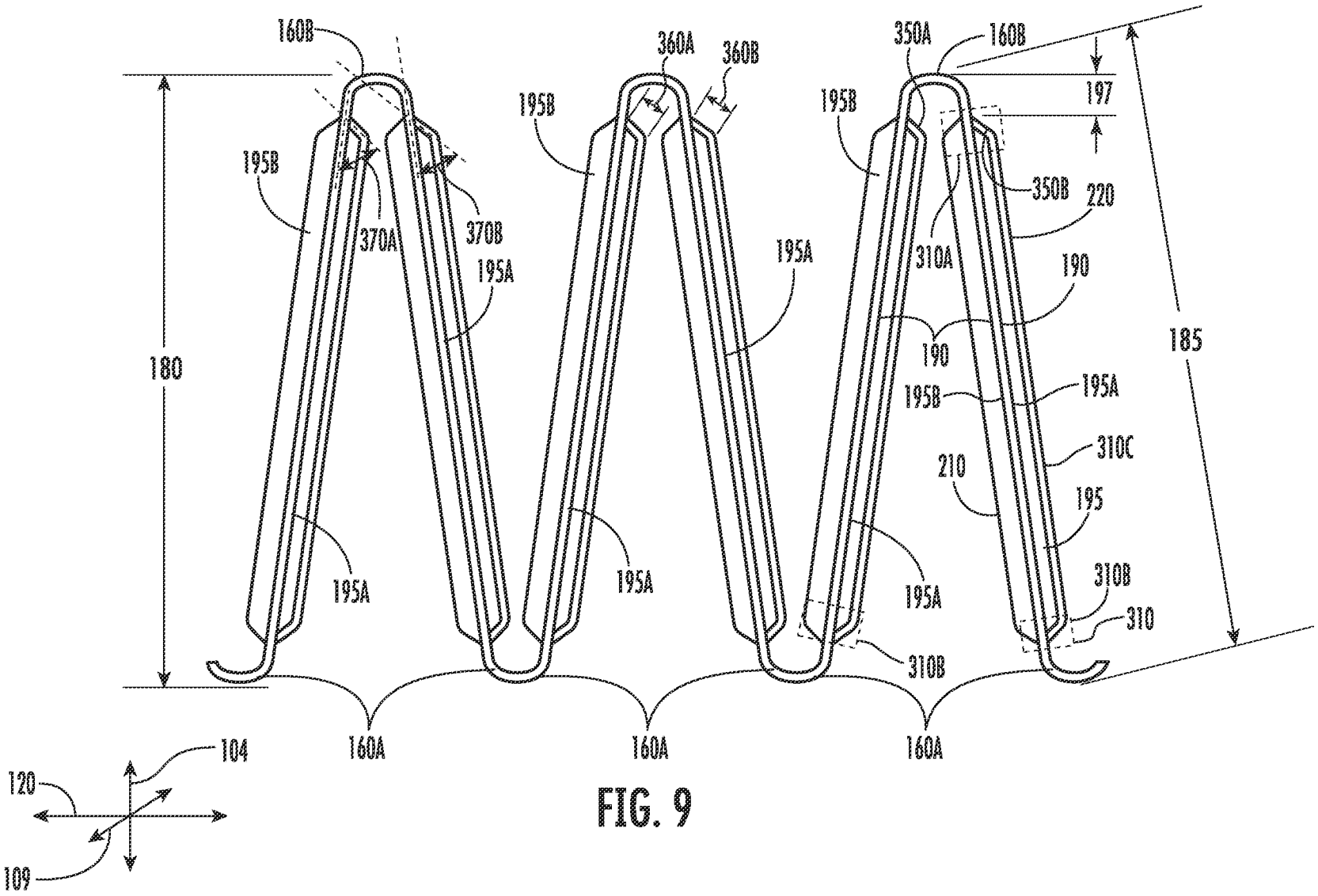
FIG. 9 shows a perspective view of the exemplary fin of FIG. 7, in accordance with one aspect of the disclosure.

With reference to FIGS. 7-9, fin segments, referred to generally as 190, may be respectively defined between each pair of lower and upper fin tips 160A, 160B. The fin segments 190 may have a length defined by the fin height 185 and may be configured to form an acute angle 192 there between. This configuration forms a triangular wave form for the fin 86.

Each fin segment 190 may define louvers, referred to generally as 200. As shown in FIG. 8, each of the louvers 200 may include a louver slat 210 and louver slot 220 adjacent to each other in the depth direction 109. The louver slot 220 may be formed by a cut or slit that extends through fin 86, e.g., through a fin thickness 230. That is, the louver slat 210 and slot 220 may be formed by first cutting a slit into the fin segment 190 and then pressing the form of the louver slat 210. This action press-forms a shape of the louver slot 220 into the fin segment 190.

As shown in FIG. 9, each louver slat 220 may be viewed to extend along the depth direction 109 by a louver width 240. Each louver slat 210 and slot 220 may be viewed to extend between the lower and upper fin tips 160A, 160B by a louver length 250 to respectively define upper and lower louver ends 250A, 250B. That is, each louver slat 210 and slot 220 pair formed from the same slit may have the same louver length 250. However, different pairs of louver slats and slots 210, 220 may have different lengths relative to each other.

For each fin segment 190, the louvers 200 may define an inner louver bank 260A distributed between the fin inner end 130 and a fin length bisecting axis (or fin bisecting axis) 270 that extends along the fin height to bisect the fin 86. The louvers 200 may define an outer louver bank 260B distributed between the fin outer end 140 and the fin length bisecting axis 270. The inner and outer louver banks 260A, 260B each may extend along a same span 280, otherwise referred to as an interrupted length, with an interrupted louver gap 290 therebetween, otherwise referred to as a turn-around louver, centered on the fin length bisecting axis 270, in the depth direction 109.

The inner louver bank 260A may open, or becomes longer, toward the fin inner end 130. This configuration defines an inner-side louver angle 300 by upper and lower louver ends 250A, 250B that may be acute relative to the axial direction 104, such that the louver slot 220 forms an outwardly splayed aperture, or air scoop. The outer louver bank 260B may be configured to essentially mirror the inner louver bank 260A.

As shown in FIG. 9, each fin segment 190 may include opposing longitudinal fin segment surfaces, generally referred to as 195, forming, for example, an upstream segment surface 195A and a downstream segment surface 195B of the fin segment 190. The louvers 200 (shown in FIG. 8) may be press-formed to extend across both upstream and downstream segment surfaces 195A, 195B and extend to a distance 197 from both lower and upper fin tips 160A, 160B. The louver slot 220 (shown in FIG. 8) may form an air scoop, otherwise referred to as a louver entry or exit, on one of the segment surfaces 195, to direct flow over the other one of the segment surfaces 195.

As shown in FIG. 9, each of the lower and upper fin tips 160A, 160B, the upstream and downstream segment surfaces 195A, 195B of the fin segments 190 may form an adjoining pair of inner facing side surfaces, e.g., that face each other along the longitudinal direction 120. Similarly, at the lower and upper fin tips 160A, 160B, the upstream and downstream segment surfaces 195A, 195B of the fin segments 190 may also form an adjoining pair of outer facing side surfaces, e.g., that face away from each along the longitudinal direction 120.

In addition, between each of the lower and upper fin tips 160A, 160B a contour of the louver slat 210 and slot 220 may define transition regions generally referred to as 310, including an upper transition region 310A at the upper louver end 250A and a lower transition region 310B, at the lower louver end 250B. A straight region 310C may extend between the upper and lower transition regions 310A, 310B.

According to an embodiment, at each fin tip 160, the transition region 310 along inner facing ones of the segment surfaces 195 (facing each other) of adjacent ones of the fin segments 190 may be referred to as inner facing transition regions. These regions may be defined by a first transition surface 350A having a first transition length 360A, and being disposed at a first acute transition angle (or first transition angle) 370A to the respective fin segment 190. The transition region 310 along outer facing ones of the segment surfaces 195 (facing away from each other) of adjacent ones of the fin segments 190 may be referred to as outer facing transition regions. These regions may be defined by a second transition surface 350B having a second transition length 360B, and being disposed at a second acute transition angle (or second transition angle) 370B to the respective fin segment 190. The first transition surface 350A may be longer than the second transition surface 350B and the first acute transition angle 370A may be less than the second acute transition angle 370B in certain instances. The transition lengths ($LT_l$) 360A, 360B, are related to the fin thickness (Ft) 230 and the ratio of the transition lengths relative to the fin thickness, $LT_l$/Ft, is between 1 and 10 with the most preferred range being between 3 and 5. The transition angles 370A, 370B range from about 15 degrees to 50 degrees.

It should be appreciated that the following ranges of the parameters, and ratios thereof, may apply for the disclosed embodiments. Referring to FIG. 2, the microchannel heat exchanger 100 includes a plurality of tubes 90, each tube configured to for a flow of fluid therethrough and one or more fins 86 located between adjacent tubes of the plurality of the tubes. The one or more fins 86 are spaced by a Fin Pitch ($F_p$) 170 and of Fin Thickness ($F_t$) 230. The fins 86 may have a fin thickness ($F_t$) of between about 50 microns and about 100 microns. The fins 86 are configured to improve the thermal energy transfer between the refrigerant flowing though the plurality of tubes and the air. In some embodiments, the ratio of fin pitch 170 and fin thickness 230, $F_p/F_t$, is between 12 and 38 and the preferred range is between 15 to 20. The Fin Height ($F_h$) 185 is related to the spacing between the adjacent tubes 90 and is configured such that an integral number of tubes can be accommodated within the available casing or plenum 60. In some embodiments, the ratio of fin height 185 and fin thickness 230, $F_h/F_t$, is between 40 and 200 and the preferred range is between about 88 to 102. The Fin Length ($F_l$) 150 is related to the air flow depth from upstream to the downstream face. In some embodiments, the fin length 150 ranges between 10 millimeters (mm) to about 40 mm and the preferred range is between about 18 to 26 mm. Further, the fin tip radius ($R_c$) 160 relates to the fin pitch 170 such that a ratio of fin tip radius 160 to the fin pitch 170, $R_c/F_p$, is between about 0.068 to about 0.42 and the preferred range is 0.2 to 0.25.

Each fin 86 includes a plurality of through openings or louvers comprising slat 210 and slot 220 arrayed along a lateral extent of the fin. The louvers improve heat transfer also assist reducing water retention of the heat exchanger by providing alternate passages for moisture and condensate to drain through the microchannel heat exchanger 100. It is desired to maximize the louver length ($L_l$) 250 with respect to the fin height ($F_h$) 185 such that the ratio, ($L_l/F_h$), is between 0.85 to 0.95 and the preferred range is between 0.88 to 0.92. The louver width ($L_w$) 240 is related to the louver count and has significant influence on the air-side thermal resistance, pressure drop and condensate drainage. The louvers act to minimize the negative influences of the hydrodynamic boundary layer growth over a plain fin surface by periodic restarts and increase the airflow path within the fin pack by redirecting the airflow laterally once the louver-directed flow is fully established. The ratio of louver width 240 and fin thickness 230, ($L_w/F_t$), is between 5 to 35 and the preferred range is between 10 to 15. Furthermore, the ratio of louver width 240 and louver length 250, ($L_w/L_l$), is between 0.06 to 0.32 and the preferred range is between 0.10 to 0.18. The louver angle 300 for the microchannel heat exchanger 100 is between 45° and 55° and the preferred louver angle 300 being 50° as applicable for the disclosed embodiments Turning to FIG. 10, another embodiment of the microchannel heat exchanger 100A is shown. It should be appreciated that various features described above with reference to the microchannel heat exchanger 100 may be the same for this embodiment of the microchannel heat exchanger 100A, except as otherwise indicated. As with the previous embodiment of the microchannel heat exchanger 100, this embodiment of the microchannel heat exchanger 100A includes a fin 86 with lower and upper fin tips 160A, 160B and fin segments 190 extending therebetween. As described above, the louvers 200 may be formed into the fin segments 190.

Figure 10:
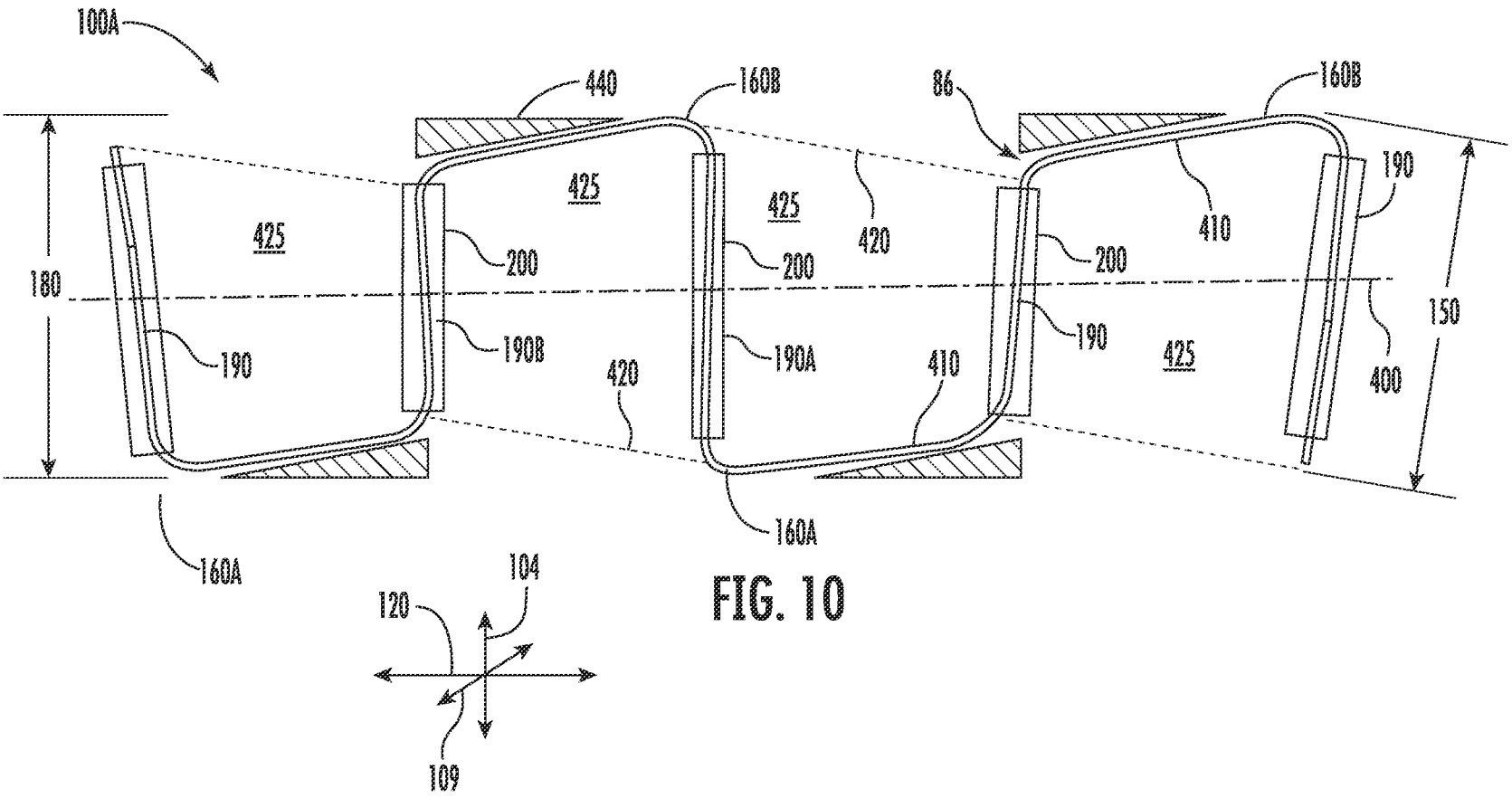
FIG. 10 shows another embodiment of the exemplary fin of FIG. 7 that may be utilized in the exemplary microchannel heat exchanger of FIG. 1, in accordance with one aspect of the disclosure.

As shown in FIG. 10, in this embodiment, the fin segments 190 may extend in the axial direction 104 such that they are substantially parallel to each other (e.g., +/−5° of one another). With adjacent ones 190A, 190B of the fin segments 190, one of the fin segments 190A is longer in the axial direction 104 than the other, thus defining longer fin segments 190A and shorter fin segments 190B. The fin height 185 and tube pitch 180 are labeled in FIG. 10. As with the embodiment shown in FIG. 7, the fin height 185 is greater (longer) than the tube pitch 180. Thus louvers 200A formed in the longer fin segments 190A are longer than louvers 200B formed in the shorter fin segments 190B.

The adjoining pair of fin segments 190A, 190B may extend in the axial direction 104 approximately the same distance from the fin center 400. A straight segment 410 may be defined between the adjoining pair of the fin segments 190A, 190B. This configuration may form alternating back to back (long side), and front to front (short side), trapezoidal fin profiles, with a dashed line 420 schematically completing the trapezoidal shape, and element 425 labelling an inside of the trapezoidal profile. In this embodiment, gaps 430 may be formed between the straight segments 410 and the tubes 90 may be filled with brazing material 440 during the brazing process.

Figure 11:
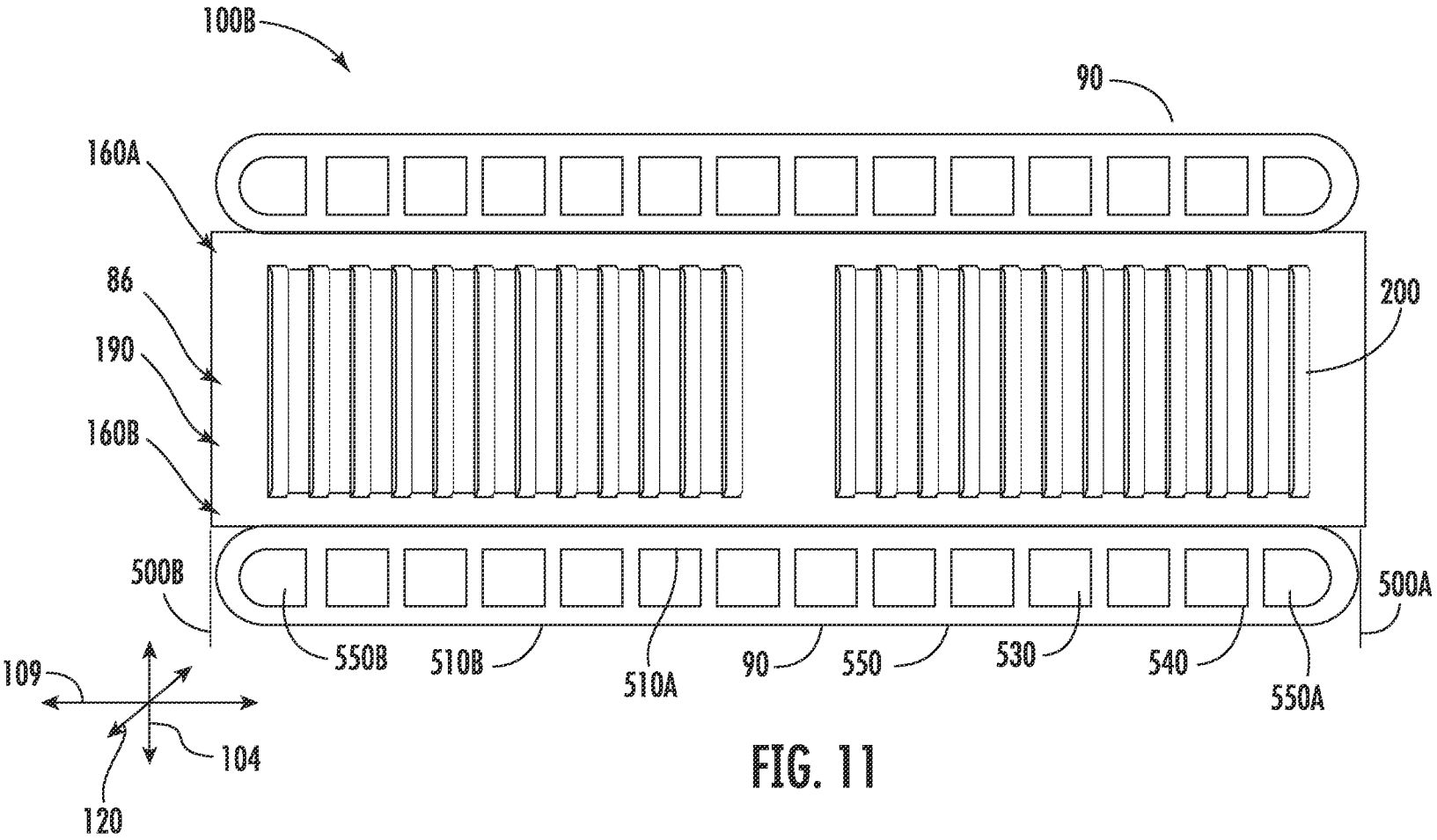
FIG. 11 shows an exemplary tube that may be utilized in the exemplary microchannel heat exchanger of FIG. 1, in accordance with one aspect of the disclosure.

Turning to FIG. 11, another embodiment of the microchannel heat exchanger 100B is shown. It should be appreciated that various features described above with reference to the microchannel heat exchanger(s) 100, 100A may be the same for this embodiment of the microchannel heat exchanger 100B, except as otherwise indicated. As with the previous embodiments of the microchannel heat exchanger 100, 110A, this embodiment of the microchannel heat exchanger 100B includes a fin 86 with lower and upper fin tips 160A, 160B and fin segments 190 extending therebetween. As described above, the louvers 200 may be formed into the fin segments 190.

The tubes 90 may be connected to the fin 86 as indicated (e.g., using any suitable brazing technique, etc.). The tubes 90 may extend from an upstream tube end 90A at the fluid header to a downstream tube end 90B at the gas header (as shown in FIG. 3). The tubes 90 may extend from a first tube end 500A to a second tube end 500B along the depth direction 109 by a tube width. The first and second tube ends 500A, 500B may be rounded. The tubes 90 may extend from an inner tube surface 510A that is brazed to the fin 85, to an outer tube surface 510B along the longitudinal direction 120 by a tube height.

The tubes 90 may be internally segmented into ports 530 extending in the longitudinal direction 120. The ports 530 may be respectively separated by webs 540, or divider walls, extending in along the axial direction 104 between the inner and outer tube surfaces 510A, 510B. The webs 540 may be spaced apart from each other in the depth direction 109. The ports 530 may define internal ports 550 spaced apart from the first and second tube ends 500A, 500B. The internal ports 550 may define rectangular or square cross sections (or profiles). The ports 530 may define end ports 550A, 550B respectively at the first and second tube ends 500A, 500B. The end ports 550A, 550B may define semi-rounded, D-shape cross sections (or profiles), defining nose-cones having an outer radius, otherwise referred to as a nose-cone radius. The ports may have a height extending in the longitudinal direction 120 and a width extending in the depth direction 109.

Figure 12:
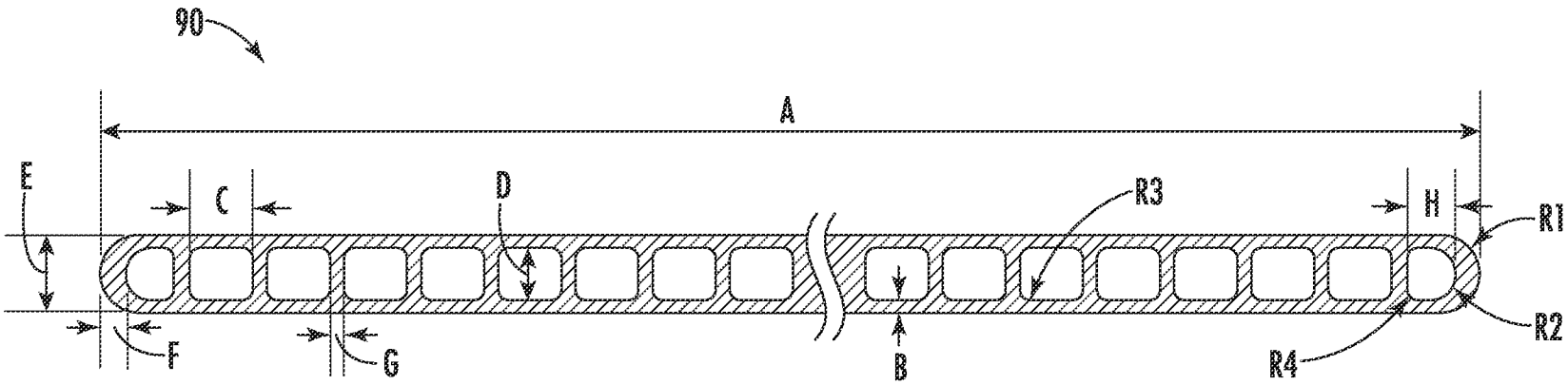
FIG. 12 shows additional aspects of the tube of FIG. 11.

Referring to FIG. 12, specific exemplary and non-limiting ranges of parameters, and ratios thereof, may apply to the disclosed tubes 90. In some embodiments the tube height E ($T_h$) may be between about 1.0 mm and 1.5 mm. The tube width A ($T_w$) is related to thermal capacity of the microchannel heat exchanger 100 and the ratio of the tube width and tube height, $T_w/T_h$, ranges from 12 to 32 with preferred range of 14 to 20. The tube wall thickness B ($TW_t$) is an important geometrical parameter for corrosion reliability standpoint. The ratio of tube wall thickness B and tube height E, $TW_t/T_w$, could range from 0.16 to 0.40 and the preferred range is 0.21 to 0.25. The tube web thickness 540 is related to the mechanical strength and burst pressure requirements for a given application. In general it is desired to minimize the totality of the tube web thickness ($B_t$) 540 in the tube to reduce material utilization and hence cost. The total tube web thickness ($TB_t$) is defined as the number of webs ($N_b$) multiplied by the individual web thickness 540, $N_b \times B_t$. In some of the embodiments of the disclosed tube 90, the ratio of the total web thickness $TB_t$ and tube width A, $TB_t/T_w$, ranges from about 0.20 to 0.40 and the preferred span is between 0.28 and 0.32. The tube thermal-hydraulic performance is influenced by the geometry of the ports 530. The most common geometry of the internal ports 550 is rectangular profile with rounded corners. The port height D is related to the tube height $T_h$ and tube wall thickness $TW_t$ and could range from 0.2 mm to 1.2 mm and the preferred values could be between 0.6 mm and 0.8 mm. The port width dimension C is related to the overall port count, web thickness 540 and tube width A. In the disclosed embodiments, the port width C can range from 0.2 mm to 2 mm and the preferred span being 0.5 mm to 0.7 mm. In most tube designs the end port 550A 550B have different port widths as compared to the internal ports 550. The end port width H can also range from 0.2 mm to 2 mm and the preferred dimension H being 0.4 mm to 0.6 mm. The port corner radius R3 ranges from 0.1 mm to 0.3 mm. In most microchannel heat exchanger tubes 90 the tube nose thickness ($N_t$) F is enhanced relative to the internal web thickness ($B_t$) G so as to provide greater structural integrity against impact damage. The ratio of nose thickness and web thickness, Nt/Bt, is between 0.5 and 5 and the preferred range is about 1.5 and 2.5.

With the above disclosed embodiments, in furnaces, tube-and-fin (RTPF) coils may be replaced with microchannel heat exchangers (MCHX) to provide enhanced performance and cost benefits. As indicated, features of the MCHX design are as follows: (a) a louver length that maximizes thermal performance, e.g., by providing a louver length to fin height ratio of greater than 80%, and preferably up to 95%; (b) a fin geometry that minimizes condensate retention due capillarity; (c) a high louver angle that promote free-draining; (d) an integral tube-pitch to maximize heat transfer surface area within a cabinet; and (e) trapezoidal flat-top fin shape with minimum corner radius for enhancing braze quality while facilitating minimum condensate retention. The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A microchannel heat exchanger comprising:

a plurality of fin segments, wherein each fin segment of the plurality of fin segments extends along a fin length direction between a fin inner end and a fin outer end and along a fin height direction between a lower fin tip and an upper fin tip, wherein the plurality of fin segments are disposed in a triangular waveform and include: a plurality of the upper fin tips, wherein adjacent ones of the upper fin tips are longitudinally spaced apart from each other by a fin pitch; and a plurality of the lower fin tips, wherein adjacent ones of the lower fin tips are longitudinally spaced apart from each other by the fin pitch;

wherein at each fin tip, the fin segments comprise inner facing surfaces that face each other and outer facing surfaces that face away from each other;

each fin segment comprises an inner louver bank disposed between the fin inner end and a fin bisecting axis, and an outer louver bank disposed between the fin outer end and the fin bisecting axis, each inner and outer louver bank comprising louvers, wherein, each of the louvers comprises:

an upper transition region at an upper louver end adjacent to the upper fin tip, a lower transition region at a lower louver end adjacent to the lower fin tip, and a straight region extending between the upper transition region and the lower transition region, wherein, for each of the louvers:

the transition regions along the inner facing surface at each fin tip comprise a first linear transition surface comprising a first transition length, disposed at a first transition angle to the fin segment;

the transition regions along the outer facing surface at each fin tip comprise a second linear transition surface comprising a second transition length, disposed at a second transition angle to the fin segment; and wherein, for each of the louvers:

the first transition length is longer than the second transition length; and the first transition angle is smaller than the second transition angle;

wherein each of the louvers includes a louver slat and louver slot adjacent to each other in a depth direction, the louver slot formed by a slit that extends through a fin thickness of the fin, the louver slat and slot being formed by cutting the slit into the fin segment and pressing a form of the louver slat, thereby press-forming a shape of the louver slot into the fin segment, the upper and lower louver ends of the inner louver bank define an inner-side louver angle that is acute relative to the fin length direction, such that each louver slot forms outwardly splayed aperture, expanding toward adjacent ones of the upper and lower fin tips, defining an air scoop, and wherein the outer louver bank mirrors the inner louver bank about the fin bisecting axis.

2. The microchannel heat exchanger of claim 1, further comprising at least one tube brazed along at least one of: the lower fin tips or the upper fin tips.

3. The microchannel heat exchanger of claim 2, comprising a fluid header and a gas header fluidly connected to the tube at opposing longitudinal ends of the tube.

4. The microchannel heat exchanger of claim 3, wherein the fin segments, between the upper and lower fin tips, are configured at an acute angle.

5. The microchannel heat exchanger of claim 1, wherein each fin tip comprises a rounded profile.

6. The microchannel heat exchanger of claim 1, wherein, at each of the fin tips: one of the fin segments is longer than another one of the fin segments, and the respective fin tip comprises a straight profile extending between the pair of the fin segments, thereby forming a trapezoidal fin profile.

7. The microchannel heat exchanger of claim 6, wherein:

the fin segments each include louvers formed thereon, wherein louvers formed on longer ones of the fin segments are longer than louvers formed on shorter ones of the fin segments.

8. The microchannel heat exchanger of claim 6, further comprising at least one tube brazed along at least one of: the lower fin tips or the upper fin tips.

9. The microchannel heat exchanger of claim 8, comprising a fluid header and a gas header fluidly connected to the tube at opposing longitudinal ends of the tube.

10. The microchannel heat exchanger of claim 6, wherein the fin segments are parallel to each other.

11. The microchannel heat exchanger of claim 1, further comprising at least one tube brazed along at least one of: the lower fin tips or the upper fin tips.

12. The microchannel heat exchanger of claim 11, comprising a fluid header and a gas header fluidly connected to the tube at opposing longitudinal ends of the tube.

13. The microchannel heat exchanger of claim 1, wherein the inner and outer louver banks have a same span along the depth direction and are spaced apart from each other by a louver gap.

14. The microchannel heat exchanger of claim 13, comprising one or more of:

a ratio of louver width to louver length of between 0.06 to 0.32;

a ratio of louver length to fin height of between 0.85 and 0.95;

a ratio of fin height to fin thickness of between 40 and 200;

a ratio of louver transition length to fin thickness of between 1 and 10;

a louver transition angle of between 15 degrees and 50 degrees;

a ratio of louver width and fin thickness is between 5 and 35; and a ratio of fin tip radius to the fin pitch of between 0.068 to 0.42.

15. The microchannel heat exchanger of claim 1, wherein at least one tube is connected along at least one of the lower fin tips or the upper fin tips, the tube extending from an upstream tube end to a downstream tube end; wherein the tube is internally segmented by webs to form ports, wherein the ports at opposing ends define end ports and the ports therebetween define internal ports, wherein the internal ports define comprise a rectangular cross section.

16. The microchannel heat exchanger of claim 15, wherein the tube is brazed to the fin tips.

17. The microchannel heat exchanger of claim 16, comprising a fluid header and a gas header fluidly connected to the tube at opposing longitudinal ends of the tube.

18. The microchannel heat exchanger of claim 15, wherein the end ports comprise semi-rounded profiles.

19. The microchannel heat exchanger of claim 18, comprising one or more of:

a port height of between 0.2 mm and 1.2 mm;

a port width of between 0.2 mm and 2 mm;

an end port width of between 0.2 mm and 2 mm;

a port corner radius of between 0.1 mm and 0.3 mm;

a ratio of a tube end-wall thickness to a tube web-wall thickness of between 0.5 and 5;

a ratio of total web thickness to tube width of between 0.20 and 0.40; and a ratio of tube wall thickness to tube height of between 0.16 and 0.40.

* * * * *